United States Patent [19]

Banweg et al.

[11] Patent Number: 4,759,314

[45] Date of Patent: Jul. 26, 1988

[54] METHOD OF CONTROL OF STEAM QUALITY FROM A STEAM GENERATOR

[75] Inventors: Anton Banweg, Canal Fulton; Murray Wiener, Akron, both of Ohio

[73] Assignee: The Babcock & Wilcox Company, New Orleans, La.

[21] Appl. No.: 132,100

[22] Filed: Dec. 14, 1987

[51] Int. Cl.[4] ..... F22D 7/00

[52] U.S. Cl. ..... 122/406 S; 122/451 S; 122/DIG. 4; 137/2; 137/5; 137/11

[58] Field of Search ..... 122/406 S, 451 S, DIG. 4; 137/2, 5, 8, 11

[56] References Cited

U.S. PATENT DOCUMENTS

| | | | |
|---|---|---|---|
| 3,412,714 | 11/1968 | Michel | 122/406 S |
| 3,428,557 | 2/1969 | Rivers | 137/11 X |
| 4,269,211 | 5/1981 | Howard et al. | 137/2 |
| 4,273,146 | 6/1981 | Johnson | 137/2 X |
| 4,460,008 | 7/1984 | O'Leary et al. | 137/5 X |

*Primary Examiner*—Edward G. Favors

*Attorney, Agent, or Firm*—Robert J. Edwards

[57] ABSTRACT

A method of controlling the steam quality leaving parallel circuits of once-through steam generators using untreated feedwater having high solids concentration wherein control valves in each circuit are actuated by signals generated by the electrical conductivities of the water phase leaving each circuit and the feedwater entering the generator unit.

1 Claim, 1 Drawing Sheet

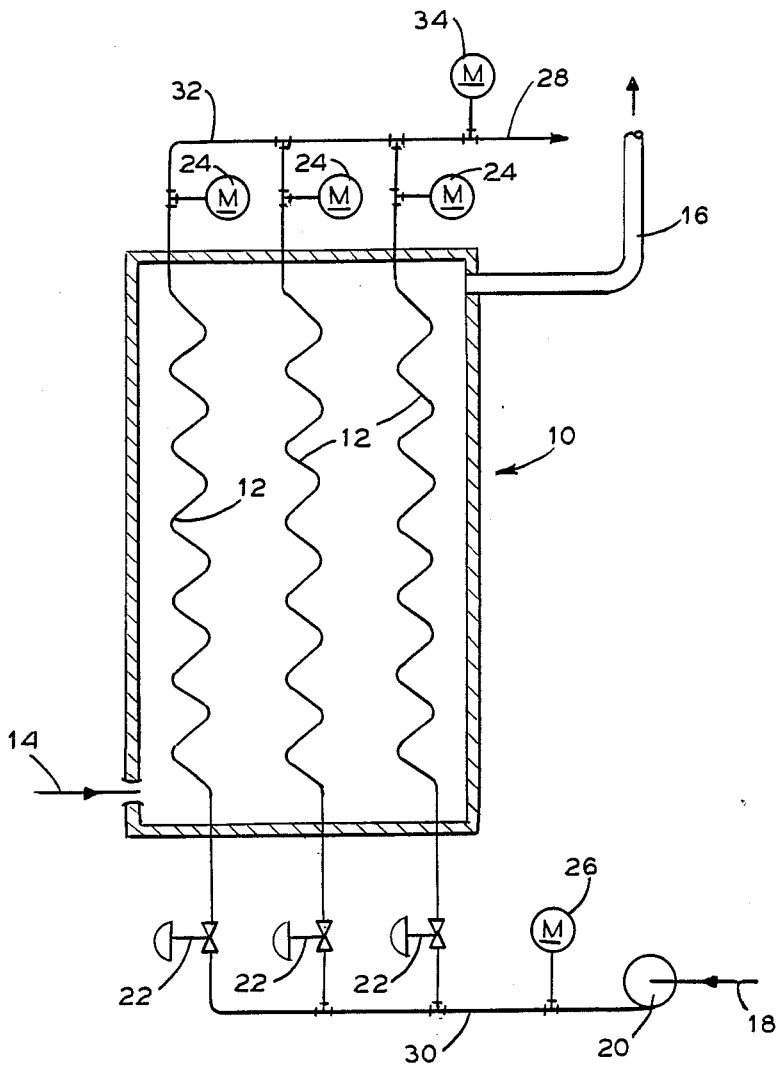
34
M
28
32
24
M
24
M
24
M
16
12
10
12
14
26
M
22
22
22
18
30
20

METHOD OF CONTROL OF STEAM QUALITY FROM A STEAM GENERATOR

BACKGROUND OF THE INVENTION

This invention relates in general to the control of steam quality from a once-through forced circulation boiler supplying steam and water mixtures to an oil field for enhanced oil recovery.

Steam injection is used in the oil industry to promote the flow of viscous, heavy oils or liquid hydrocarbons from tar sands to producing wells by heating the deposits and reducing their viscosity. Currently, practically all steam generators for this service are small, portable, once-through type units fired with oil or gas. They generally utilize available, untreated water at the site which contains high concentrations of dissolved solids. Small size units consist of a single tube formed into a helix or having a serpentine flow path. Steam quality leaving these monotube boilers is controlled to about 90% steam by weight. Larger units consist of three or more tubes in parallel. Flow to each circuit is metered and controlled for an average outlet quality of about 80% steam by weight. The lower quality steam and consequent higher water flow in the output of the multi-tube unit compared to a monotube design is to provide an added factor of safety for flow unbalances and upset heat absorption rates. It is vital to successful operation of these once-through units utilizing untreated feedwater to prevent evaporation to dryness in any tube which could result in the deposition of solids in that tube, leading to tube failure and a forced outage.

SUMMARY OF THE INVENTION

The invention provides a method of control for the safe, efficient operation of multi-tube once-through forced circulation steam generator units using untreated feedwater having high concentrations of dissolved solids by continuous measurement of the conductivity of the water phase of the wet steam leaving each circuit and comparing this to the inlet boiler water conductivity. These conductivity ratios actuate flow control valves at the inlet of each circuit to maintain equal steam quality leaving each circuit, thus eliminating the effects of flow unbalances and upset heat absorption rates.

BRIEF DESCRIPTION OF THE DRAWINGS

The sole FIGURE in the drawing is schematic representation of a once - through steam generating unit.

DETAILED DESCRIPTION

The drawing is a schematic representation of a once-through steam generating unit or boiler 10 comprising three parallel tube circuits 12 and illustrating features of the invention. It should be understood, however, that a greater or lesser number of parallel tube circuits 12 may be used in the invention. Feedwater line 18 introduces high solids concentration untreated feedwater to pump 20 from which flow is directed to inlet header 30. The parallel tube circuits 12 connect to inlet header 30 and receive liquid flow therefrom. Flow control valves 22 are located at the inlet of each circuit. Tube circuits 12 enter steam generating unit 10 and absorb heat generated from the combustion of fuel and air introduced by burners 14. Exhaust combustion gas leaves unit 10 via flue 16. A steam and water mixture leaves the boiler and enters outlet header 32 which collects the mixture for delivery to outlet pipe 28. A metering device 34 measures the steam and water mixture output leaving the outlet header 32 and transmits a signal to a controller, not shown, which regulates the feedwater output of pump 20 to satisfy the boiler output demand. Meters 24 measure the electrical conductivity of the water phase at the outlet of each circuit 12. Meter 26 measures the electrical conductivity of the feedwater. These conductivities are continuously monitored and any variation of the ratio of outlet to inlet conductivity in any circuit 12 from a chosen fixed value will signal the control valve 22 in the at circuit to open or close thus maintaining equal steam quality in each circuit 12. For example, if the desired steam quality leaving each circuit 12 is 80%, the ratio of outlet to inlet conductivity should be maintained at a value of 5 by a control signal actuating valves 22. Other values of the conductivity ratio as a function of steam quality are given in Table 1.

TABLE 1

| Q | W | R |
|---|---|---|
| 90 | 10 | 10 |
| 80 | 20 | 5 |
| 70 | 30 | 3.33 |
| 60 | 40 | 2.50 |
| 50 | 50 | 2 |

where,

Q=outlet quality, percent steam by weight leaving circuit,

W=percent water by weight in steam leaving circuit,

R=conductivity ratio=100/ W

This method of determining steam quality by electrical conductivity is based on the fact that dissolved solids, whether acids, bases or salts, are quite completely ionized in dilute solution, and therefore conduct electricity in direct proportion to the total solids dissolved. The increased concentration of dissolved solids in the water phase leaving each circuit 12 compared to that of the feedwater is reflected in a similar increase in electrical conductivity.

The inventive method provides an inexpensive, accurate means of eliminating tube failures and hazardous operation of once-through steam generating units having multiple parallel circuitry utilizing untreated feedwater of high dissolved solid concentration.

While in accordance with the provisions of the statutes there is illustrated and described herein a specific embodiment of the invention and those skilled in the art will understand that changes may be made in the form of the invention covered by the claims, and that certain features of the invention may sometimes be used to advantage without corresponding use of the other features.

The embodiments of the invention in which an exclusive property or privilege is claimed are defined as follows:

1. A method of control to obtain equal steam quality having liquid and steam phases leaving each parallel tube circuit of a multi-tube once-through, forced circulation steam generating unit utilizing untreated feedwater having high concentrations of dissolved solids comprising:

measuring the electrical conductivity of the water phase of the fluid leaving each parallel tube circuit;

measuring the electrical conductivity of the feedwater entering the steam generating unit;

generating a control signal from the ratio of the water phase conductivity to the feedwater conductivity, and actuating flow control valves in each parallel tube circuit by the control signal to maintain a given, fixed value of the conductivity ratio for each tube circuit.

* * * * *